US012644293B2

(12) United States Patent
Yoder

(10) Patent No.: US 12,644,293 B2
(45) Date of Patent: Jun. 2, 2026

(54) HAND-HELD VIBRATING CEMENT TROWEL

(71) Applicant: CK Industry LLC, Hicksville, OH (US)

(72) Inventor: Christ M. Yoder, Hicksville, OH (US)

(73) Assignee: CK Industry LLC, Hicksville, OH (US)

( * ) Notice: Subject to any disclaimer, the term of this patent is extended or adjusted under 35 U.S.C. 154(b) by 366 days.

(21) Appl. No.: 18/100,323

(22) Filed: Jan. 23, 2023

(65) Prior Publication Data

US 2023/0235579 A1 Jul. 27, 2023

Related U.S. Application Data

(60) Provisional application No. 63/302,508, filed on Jan. 24, 2022.

(51) Int. Cl.
*E04F 21/24* (2006.01)

(52) U.S. Cl.
CPC ..... *E04F 21/242* (2013.01)

(58) Field of Classification Search
CPC ..... E04F 21/242; E01C 19/178; E01C 19/38
See application file for complete search history.

(56) References Cited

U.S. PATENT DOCUMENTS

| | | | | |
|---|---|---|---|---|
| 7,465,121 | B1 * | 12/2008 | Hendricks | E04F 21/161 15/235.4 |
| 8,439,600 | B2 | 5/2013 | Brening | |
| 11,142,875 | B2 | 10/2021 | Lightfoot | |
| 2012/0183351 | A1 * | 7/2012 | Brening | E04G 21/066 404/114 |
| 2019/0100887 | A1 * | 4/2019 | Contrino | E04F 21/161 |
| 2021/0207389 | A1 | 7/2021 | Schmidt et al. | |

OTHER PUBLICATIONS

2ilp.ca (web site), Vibrating Hand Float Tool—Home, accessed Jan. 21, 2023, Toronto, Canada.
2ilp.ca (web site), Vibrating Hand Float Tool—Executive Summary, accessed Jan. 21, 2023, Toronto, Canada.

* cited by examiner

*Primary Examiner* — Andrew A Horton
(74) *Attorney, Agent, or Firm* — Kevin R. Erdman; Brannon Sowers & Cracraft PC

(57) ABSTRACT

The present invention involves a hand-held tool with a battery powered vibrator positioned on the smoothing plane of the float to help settle the concrete while the operator smooths the surface.

20 Claims, 2 Drawing Sheets

HAND-HELD VIBRATING CEMENT TROWEL

CROSS-REFERENCE TO RELATED APPLICATIONS

The present application is a nonprovisional U.S. Patent application which claims priority under 35 U.S.C § 119(e) of U.S. Patent Provisional Application Ser. No. 63/302,508, filed Jan. 24, 2024, the disclosures of which are incorporated by reference herein.

PRIOR ART

The field of the invention is that of construction. More particularly, the invention deals with tools used with concrete in the construction process.

BACKGROUND OF THE INVENTION

Cement may be a mixture of various earth components in the form of fine ground powders, mainly lime and silica, combined with water to form a slurry that upon the evaporation of the water becomes a solid capable of supporting great amounts of weight. Concrete is a combination of cement and aggregate (gravel or crushed stone, typically around 75% of the mixture), binding agents, chemical additives and water that provides an enhanced material support. As such, cement and/or concrete is used in many construction projects as a foundation, and also for walls, support structures, and other building components.

In the course of pouring and finishing cement or concrete mixtures in a construction project, the mixture components may not be completely disbursed within the slurry, and if allowed to harden in that form may contain interior water pools or air pockets that detract from the structural integrity of the poured mixture. Further, as the mixture settles, most construction uses of concrete or cement prefer that the surface of the mixtures be smooth once set with a cream portion of the mixture at or near the surface, and maintain that state in the finished form. Large vibrators are used on concrete structure to randomize the slurry mixture and to thus rearrange the various particulate in the slurry in a close configuration to have the most dense and compact, and hence structurally sound, concrete possible. Additionally, having the cream at the surface facilitates the finishing of the concrete surface with preferred color and texture.

In many types of construction, hand tools must be used in many edges and border regions to smooth the surface. Those hand tools, for example trowels, are additionally used to agitate those edge and border regions to facilitate the close configuration of the drying mixture and ascension of the cream. In particular, additional manipulation is needed on the surface of the poured mixture to facilitate the cream's ascension to the surface. With a hand trowel, this may require several or dozens of manual beating of the concrete surface with the trowel to appropriately settle the cement in those edge and border areas, removing air trapped within the poured mixture and urging the cream to the surface. These manipulations of the poured mixture significantly raise the amount of time required to finish those areas, thus negatively impacting the efficiency of the users of the hand tools.

Some hand held trowels have piexoelectric vibration devices or small motors disposed in their handles, but these devices fail to deliver sufficient vibratory forces to the areas of the surface being settled. Improvements in hand held vibrating trowels are desired so that a greater amount of vibration may be applied to these small and hard to reach areas, to improve the efficiency of the tool and minimize the labor required to apply the tool.

SUMMARY OF THE INVENTION

The present invention, in one aspect, is a trowel with a battery powered vibrator counter-balanced motor positioned directly below the handle on the smoothing plane to help settle the concrete while the operator smooths the surface.

In several embodiments of the invention, the handle of the trowel has a vibrator that is coupled to the smoothing plane, or float, of the tool to agitate the settling mixture. By having the tool vibrate while the operator is performing the smoothing of the mixture surface, the concrete may settle much more quickly than conventional trowels thus requiring fewer strokes of the trowel. The trowel may be battery powered, optionally with a variable control vibration setting.

In one embodiment, the invention involves a hand-held tool for finishing concrete with a float. The tool comprises a handle housing defining first and second post sections, a hand gripping section, and a vibration motor section. The first and second post sections are configured to be mounted on the float. The vibrator is disposed in a motor section of the handle housing and is configured to be positioned directly on the float. The tool further comprises a battery coupled to the vibrator. The tool further comprises a float, the handle housing mounted to the float, optionally bolted to the float. The hand gripping section includes a hand grip, optionally a removable hand grip. The handle housing has a battery connection hub electrically coupled to the vibrator, and optionally has a battery, with the battery being electrically coupled to the vibrator. The vibrator may have an actuation switch, optionally located on the upper surface of the handle housing. The actuation switch may adjusts the amount of vibration created by the vibrator. The handle housing may comprise at least two shell housing sections, which may be connected by fasteners through corresponding holes in the at least two shell housing sections. The housing sections define a plurality of through holes allowing a bolt to extend through and connect with a float, with the plurality of through holes being defined in the first and second post sections. The vibration motor section has a cylindrical shape and defines a plurality of through holes with fasteners extending within the through holes to secure the vibrator.

Another embodiment of the invention involves a hand-held tool for finishing concrete with a float. The tool comprises a handle housing defining first and second post sections, a hand gripping section, and a vibration motor section, and a vibrator disposed in a cylindrically shaped motor section of the handle housing; and a float. The first and second post sections are configured to be mounted on the float such that the motor section is positioned directly on the float. An axis of the cylindrical shape may be parallel to the float.

A further embodiment of the invention involves a hand-held tool for finishing concrete. The tool comprises a handle housing defining first and second post sections, a hand gripping section, and a vibration motor section, and a vibrator disposed in a cylindrically shaped motor section of the handle housing; with a float and battery. The float defines a length. The first and second post sections may be configured to be mounted on the float such that the motor section is positioned directly on the float with an axis of the motor section being parallel with the float lower surface. The battery may be positioned on one of the first and second post sections, operably coupled to the vibrator, with the length of the float extending beyond the battery.

BRIEF DESCRIPTION OF DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
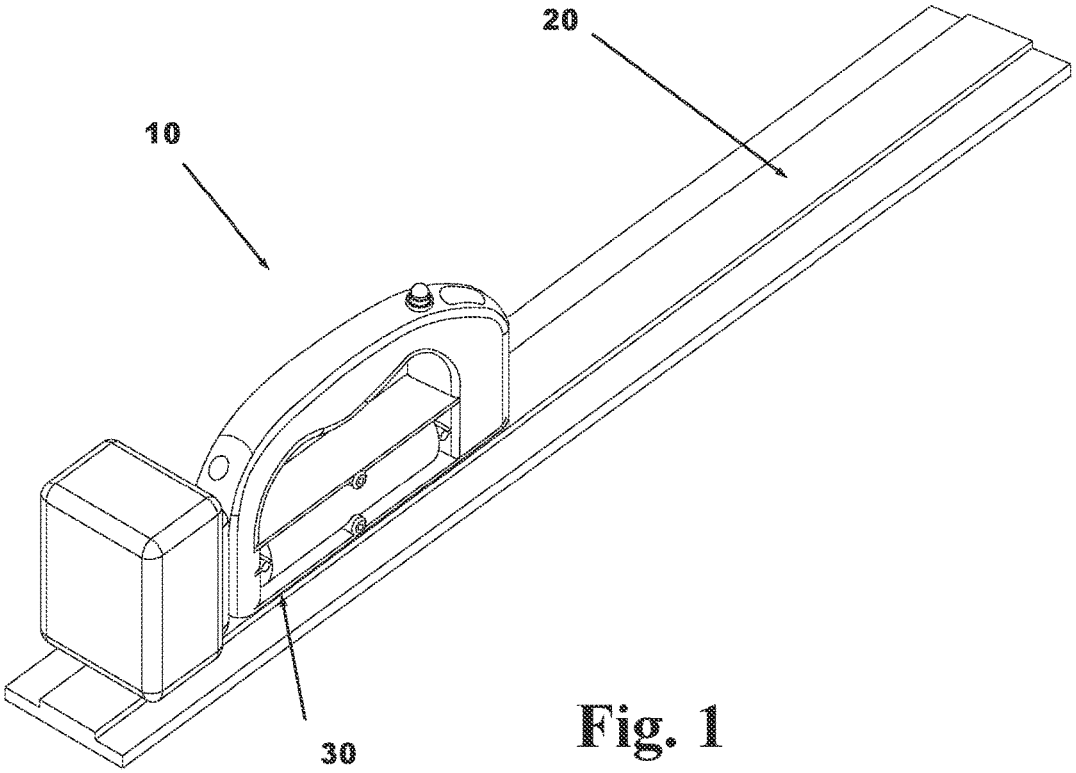
FIG. 1 is a perspective view of one embodiment of the present invention.
Figure 2:
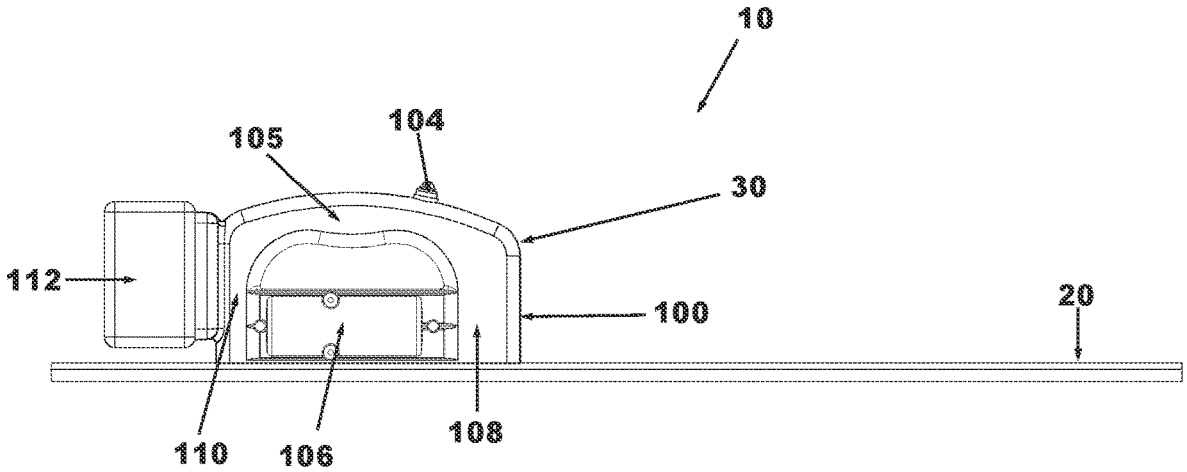
FIG. 2 is a side view of the embodiment of FIG. 1.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DETAILED DESCRIPTION OF THE INVENTION

The embodiments disclosed below is/are not intended to be exhaustive or limit the invention to the precise form disclosed in the following detailed description. Rather, the embodiment is chosen and described so that others skilled in the art may utilize its teachings.

One embodiment of the hand tool of the invention shown in FIGS. 1-5 has a configuration much like a conventional hand trowel or darby used for smoothing cement. In one embodiment, a vibrator has its housing mounted to a magnesium float, underneath the handle. The operator grips the handle, and with the counter-balanced motor directly underneath the gripped handle the operator may direct the vibration by the operator's placement of the trowel with the operator's hand. With the vibrator mounted to the float, when vibration is activated and the user is smoothing concrete, for example under an existing wall or other edge or border area, the surface upon which the float is smoothing receives the vibration created by the vibrator, thus facilitating the close configuration of the concrete around the edge or border area.

The vibrator may be powered by a battery, in one embodiment a conventional power tool rechargeable battery detachably fixed to the trowel. The vibrator may be of a similar configuration as those used in a personal massage vibrator, in one exemplary embodiment. The particular configuration of a counter-balanced motor is well known in the art and will not be discussed in further detail. The physical size of the motor is important to the amount of vibration provided by the trowel, so having a sufficiently large physical footprint for the vibrator is significant for the trowel to provide desired amounts of vibration to the cement surface. With the vibrator affixed to the float, for example without limitation, by being bolted to the float with its motor axis being generally parallel to the plane of the float and its lower outer surface contacting the float, its vibrational energy is readily transmitted to the material being smoothed by the float. While know cement vibration units are large, for example several feet in length with large gas powered motors, the hand-held tool of the disclosed embodiments may range from, for example without limitation, twelve to sixteen inches. With the smaller dimensions and lighter weight, the hand-held tool may reach the edge and border regions of a particular cement pour more effectively than the larger units. The float has a planar body with a flat lower surface, with post sections being mounted on the body. The body is elongated in one of the dimensions of length and width with the posts extending in the dimension of height. The body extends in one of the dimensions of length and width for an extent more than twice longer than the handle housing. Additionally, by providing the vibration energy to those regions, the surfaces settle much quicker and the finishing workers may complete their jobs much more quickly and efficiently. Further, many cement floors and other structures must be poured around large piping and other structural components making the regions around those items much more difficult to reach by conventional concrete vibrators.

In one embodiment, the invention comprises a handle with a vibrator, with the handle adapted to be connected to a float and the vibrator adapted to received operative energy from a battery. In one embodiment, the vibrator is a conventional 12 volt DC electric motor. In another embodiment, the vibrator is a conventional 18 volt DC electric motor. In a further embodiment, the vibrator is a conventional 24 volt DC electric motor. The DC electric motor has oppositely disposed counterweighted shafts to create the vibration. In another embodiment, the vibrator may be a similarly sized AC electric motor. In the various embodiments of the invention, the handle may be configured for ergonomic concerns, with an activation switch and/or an adjustment knob for user activation and control of the vibrator.

Conventional floats have two or more bolt locations allowing for the attachment of a handle. In embodiments of the invention, the handle component may have two or more bolt locations for attachment. For example, without limitation, a housing of an embodiment of the invention may have two, three, or four bolt holes with spacing that may accommodate several different bolt spacing attachment patterns on different floats.

In embodiments of the invention, the handle housing may be integrally molded, or alternatively formed as a half shell with two mating housing portions bolted together to form a housing with a hand gripping handle, a vibrator motor location, and cavities for bolts to either hold the two halves together, or to define through holes for attaching the housing to the float. In embodiments of the invention, the through holes of the housing are located on opposite sides of the vibration motor housing section, so that the vibration motor is located directly underneath the hand gripping section, and the bottom of the vibration motor housing section directly abuts the float. The particular configuration of a float and associated handle attachment mechanism is well known in the art and will not be discussed in further detail.

Looking to a particular embodiment of the invention shown in the drawings, FIG. 1 shows a perspective view of the trowel 10. Trowel 10 comprises float 20, of conventional design, and vibrating handle mechanism, including a vibrator section and a motor section, collectively referred to as handle 30. As shown in greater detail in the particular embodiment of FIG. 2, handle 30 comprises half shell housings 100 and 102 (shell housing 102 not shown in FIG. 2, appearing in FIG. 3). Shell housings 100 and 102 have hand gripping section 105 with actuator 104 extending from its upper surface. Shell housings 100 and 102 further define vibration motor section 106, for housing the vibration motor, and side post sections 108 and 110 for defining through holes 121-124 (See FIG. 3). Battery section 112 is positioned on one of the side post sections, in the disclosed embodiment abutting post section 110. In the disclosed embodiment, battery section 112 is a commercially available portable power tool type of battery with a mating electrical connection formed in post section 110, to provide power from battery 112 to vibration motor section 106 via a hub and internal wiring (not shown). The particular configuration of battery and associated internal wiring mechanism is well known in the art and will not be discussed in further detail.

Figure 3:
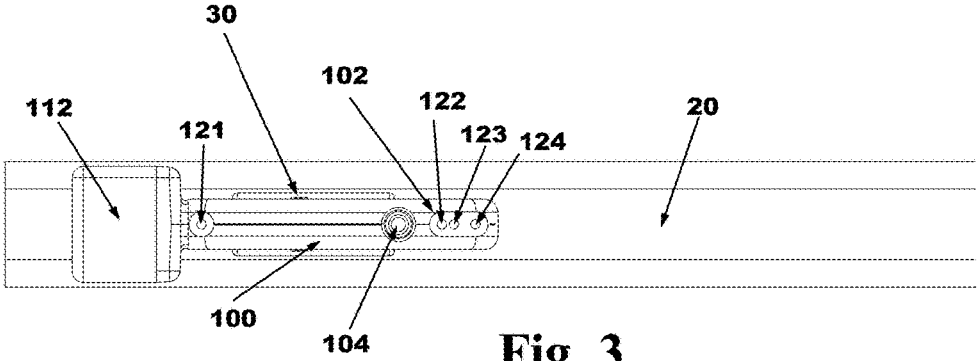
FIG. 3 is a top plan view of the embodiment of FIG. 1.

The top plan view of FIG. 3 shows how vibrating handle mechanism 30 may be attached to float 20. Corresponding shell housings 100 and 102 are placed together and form a series of through holes 121-124. At least one of through holes 121-124, typically two, correspond to bolt mounting areas (not shown) of float 20 so that handle 30 securely attaches to float 20, allowing for an operator to manually grab gripping section 105 and thus operate trowel 10 to smooth a poured concrete surface. Actuation switch 104, in the illustrated embodiment, is also positioned on the upper surface of handle 30 to allow for easy manual access to actuation of the tool. Alternatively, actuation switch 104 may be located at another position on the surface of shell housings 100 and 102, or in other embodiments actuation switch may be a wirelessly activated circuit to allow control of the tool.

Figure 4:
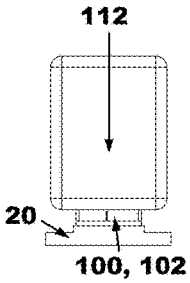
FIG. 4 is a backside view of the embodiment of FIG. 1.
Figure 5:
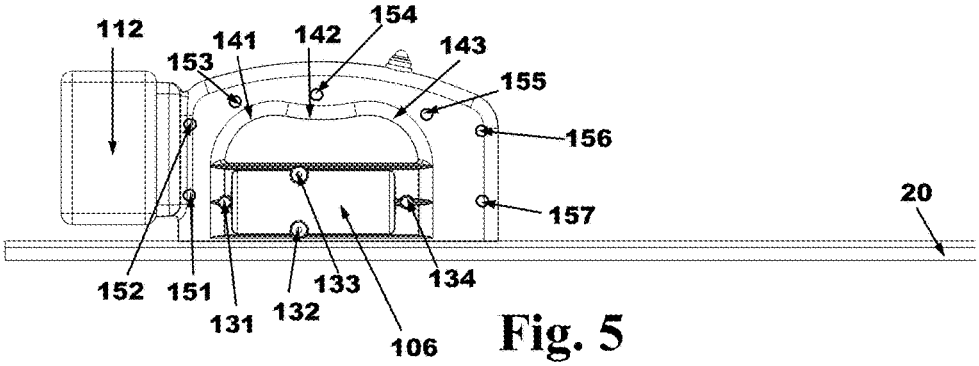
FIG. 5 is a side detailed view of an embodiment of the invention.

FIG. 4 shows a side view of battery 112, float 20, and shell housings 100, 102. FIG. 5 shows a more detailed view of shell housing 100 from FIG. 2, omitting some of the reference numerals of the previous FIG. 2 to focus on particular features of its structure. As mentioned previously, shell housings 100, 102 have mating structures that define both through holes 121-124 (See FIG. 3), and connection holes 131-134. Connection holes 131-134 are aligned so that a bolt, rivet, or similar fastener may extend and bind together shell housings 100, 102. Connection holes 131-134, in the illustrated embodiment, are disposed on four sides of vibration motor section 106 and have fasteners extending therethrough for securing the structure. Gripping sections 141-143 are configured to accommodate a human hand for manual gripping of trowel 10 and movement. Such gripping sections 141-143 may optionally be fabricated from more resilient materials to facilitate such use. Optionally, gripping sections may be separate and distinct from the structure of shell housings 100, 102, such as a rubber-like gripping section that bends around a projection (not shown) of shell housings 100, 102 to provide a favorable ductile feel for an operator of trowel 10. Additionally, connection holes 151-157 are defined by shell housings 100, 102 to provide a similar connection fastening and are disposed on the upper periphery of handle 30, and have fasteners extending therethrough for securing the structure.

As shown in FIG. 1, vibration motor section 106 is cylindrical and houses a motor with counterweights. Connection holes 131, 134 are located at disc-like ends of the cylinder defined by section 106, whereas connection holes 132, 133 are located in the middle of section 106 such that the motor cores (not shown) may be located at the ends of section 106 while the rotating axis of those motors (not shown) may extend through portions of section 106 unimpeded by connection holes 132, 133. This allows vibration motor section 106 to directly contact float 20 through shell housings 100, 102 and thus imparting a maximal amount of vibration to float 20 where the operator positions handle 30.

Further, the position of vibration motor section 106, in the exemplary embodiment, directly below gripping sections 141-143 so that the operator of trowel 10 may precisely apply vibration to operator selected portions of the poured concrete. Optionally, as shown in the exemplary drawings, handle 30 may be mounted at one end of float 20, with battery section 112 configured to extend over, but not beyond, that end of float 20. This further facilitates the operator of trowel 10 to locate and manipulate poured concrete with vibration in tight spaces, for example without limitation, around pipes, drains, and near walls.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A hand-held tool for finishing concrete with a float, the tool comprising:

a handle housing defining first and second post sections, a hand gripping section, and a vibration motor section;

the first and second post sections being configured to be mounted on the float, the float having a planar body with a flat lower surface, the first and second post sections being mounted on the body, the body being elongated in one of the dimensions of length and width with the posts extending in the dimension of height, the body extending in one of the directions of length and width for an extent more than twice longer than the handle housing; and a vibrator disposed in a motor section of the handle housing, the motor section configured to be positioned directly on the float.

2. The hand-held tool of claim 1 further comprising a battery coupled to the vibrator.

3. The hand-held tool of claim 1 further comprising a float, the handle housing mounted to the float.

4. The hand-held tool of claim 3 wherein the handle housing is bolted to the float.

5. The hand-held tool of claim 1 wherein the hand gripping section includes a hand grip.

6. The hand-held tool of claim 1 wherein the handle housing has a battery connection hub electrically coupled to the vibrator.

7. The hand-held tool of claim 6 further comprising a battery, with the battery being electrically coupled to the vibrator.

8. The hand-held tool of claim 1 wherein the vibrator has an actuation switch.

9. The hand-held tool of claim 8 wherein the actuation switch is located on an upper surface of the handle housing.

10. The hand-held tool of claim 8 wherein the actuation switch adjusts the amount of vibration created by the vibrator.

11. The hand-held tool of claim 1 wherein the handle housing comprises at least two shell housing sections.

12. The hand-held tool of claim 11 wherein the at least two shell housing sections are connected by fasteners through corresponding holes in the at least two shell housing sections.

13. The hand-held tool of claim 11 wherein the at least two shell housing sections define a plurality of through holes allowing a bolt to extend through and connect with a float.

14. The hand-held tool of claim 13 wherein the plurality of through holes are defined in the first and second post sections.

15. The hand-held tool of claim 1 wherein the vibration motor section has a cylindrical shape.

16. The hand-held tool of claim 15 wherein the vibration motor section defines a plurality of through holes and a fastener extends within the through holes to secure the vibrator.

17. The hand-held tool of claim 1 wherein the gripping section includes a removable hand grip.

18. A hand-held tool for finishing concrete with a float, the tool comprising:

a handle housing defining first and second post sections, a hand gripping section, and a vibration motor section, and a vibrator disposed in a cylindrically shaped motor section of the handle housing; and a float, the first and second post sections being configured to be mounted on the float and extending in the dimension of height such that the motor section is positioned directly on the float, the float having a planar body with a flat lower surface, the first and second post sections being mounted on the body, the body being elongated in one of the dimensions of length and width, the body being elongated more than twice longer than the handle housing.

19. The hand-held tool of claim 18 wherein an axis of the cylindrical shape is parallel to the float.

20. A hand-held tool for finishing concrete with a float, the tool comprising:

a handle housing defining first and second post sections, a hand gripping section, and a vibration motor section, and a vibrator disposed in a cylindrically shaped motor section of the handle housing;

a float having a length, the first and second post sections being configured to be mounted on the float such that the motor section is positioned directly on the float with an axis of the motor section being parallel with a lower surface of the float, the float extending in one of length and width for an extent more than twice longer than the handle housing; and a battery positioned on one of the first and second post sections, the battery operably coupled to the vibrator, and the length of the float extending beyond the battery.

* * * * *